US005934630A

United States Patent [19]

Williams et al.

[11] Patent Number: 5,934,630

[45] Date of Patent: Aug. 10, 1999

[54] FURNITURE LEG MOUNTING MECHANISM

[75] Inventors: David A. Williams, London; Roger J. Carr, Surrey; Russell Plant, London, all of United Kingdom

[73] Assignee: Steelcase Inc., Grand Rapids, Mich.

[21] Appl. No.: 08/678,973

[22] Filed: Jul. 12, 1996

[30] Foreign Application Priority Data

Jul. 12, 1995 [GB] United Kingdom ..... 9514207

[51] Int. Cl.[6] ..... F16M 11/16

[52] U.S. Cl. ..... 248/188; 403/325; 248/222.1

[58] Field of Search ..... 108/157; 248/188, 248/222.1; 403/321, 325, 353

[56] References Cited

U.S. PATENT DOCUMENTS

| | | | |
|---|---|---|---|
| 2,647,294 | 8/1953 | Davis . | |
| 3,329,383 | 7/1967 | Pilliod et al. | 248/188 |
| 3,910,206 | 10/1975 | Jay | 248/188 X |
| 4,186,976 | 2/1980 | Okada | 403/321 X |
| 4,188,147 | 2/1980 | Murphy . | |
| 4,793,579 | 12/1988 | Finkelstein et al. | 248/188 |
| 4,991,325 | 2/1991 | Teduschi | 248/188 X |
| 5,056,746 | 10/1991 | Parsons et al. . | |
| 5,232,303 | 8/1993 | Rubner . | |
| 5,341,749 | 8/1994 | Noakes . | |
| 5,390,571 | 2/1995 | Fox, III et al. | 403/325 X |
| 5,472,254 | 12/1995 | Wander | 403/321 X |
| 5,611,638 | 3/1997 | Dorr et al. | 403/321 X |

FOREIGN PATENT DOCUMENTS

| | | |
|---|---|---|
| 0433621 | 6/1991 | European Pat. Off. . |
| 0571650 | 12/1993 | European Pat. Off. . |
| 814972 | 6/1959 | Germany . |
| 2507496 | 8/1976 | Germany . |
| 9304661 | 8/1993 | Germany . |
| 364292 | 1/1932 | United Kingdom . |
| 9214064 | 8/1992 | WIPO . |

*Primary Examiner*—Peter M. Cuomo
*Assistant Examiner*—Stephen Vu
*Attorney, Agent, or Firm*—Price, Heneveld, Cooper Dewitt & Litton

[57] ABSTRACT

A mounting mechanism for detachable interconnecting furniture parts and the like comprises a first catch movable between an engaged position in which the first catch is engageable with a furniture part to retain the furniture part, and a release position in which the first catch is releasable from the furniture part. A second catch may be provided and is moveable between an engaged position in which the second catch is engageable with another furniture part to retain that furniture part, and a release position in which the second catch is releasable from that furniture part. A locking mechanism may also be provided to lock the second catch in the release position.

36 Claims, 7 Drawing Sheets

FURNITURE LEG MOUNTING MECHANISM

BACKGROUND OF THE INVENTION

This invention relates to mounting mechanisms for securing furniture parts together, and in particular, to a mounting mechanism for removable table legs and the like.

Detachable legs for pieces of furniture are generally attached to the furniture article by complicated devices, and often require tools to attach and detach the leg to and/or from the furniture article.

When a conference/meeting table is to be left in place for a long period of time in a "permanent" configuration, there is no need to provide a mounting mechanism which allows easy detachment of the legs from the table. However, it is advantageous to supply certain furniture articles such as tables, in a flat-pack form to minimize carriage costs. Thus, it is still important for the legs to be easily attachable. Further, by providing an easy attachment or mounting mechanism, the initial construction of the table need not require the presence of skilled personnel.

SUMMARY OF THE PRESENT INVENTION

Accordingly, this invention seeks to provide a mounting mechanism for securing a furniture leg to a piece of furniture, which mechanism does not suffer from the above disadvantages and which provides a solid attachment between a furniture leg and the piece of furniture, the leg being easy to attach and detach without the use of tools.

Conference/meeting tables which comprise smaller tables which are linked or ganged together often need to be reconfigured to provide appropriate seating plans. Additionally, the number of people wishing to sit at the conference/meeting table will vary so the configuration of the table will need to be altered to accommodate such varying numbers. Accordingly, it is necessary for the smaller tables making up the conference/meeting table to link together in a number of configurations.

It is known to provide a furniture leg which gangs together two tabletops thereby reducing the number of legs required to support the composite conference/meeting table. However, when such a composite table is being dismantled, it is necessary to release all the links to one table top simultaneously to allow removal of that table top from the composite table. At least two people are required to perform this operation. To attempt to dismantle such a table single-handedly is fraught with difficulties, if not impossible.

Another aspect of the present invention seeks to provide a mounting mechanism for securing tabletops or the like together which overcomes the above disadvantages and which provides a solid and strong attachment between, for example, two tabletops.

Accordingly, the present invention provides a mounting mechanism comprising a first catch movable between an engaged position in which the first catch is engageable with a furniture part to retain the furniture part and a release position in which the first catch is releasable from the furniture part, a second catch moveable between an engaged position in which the second catch is engageable with another furniture part or the same furniture part to retain that furniture part and a release position in which the second catch is releasable from that furniture part, and a lock or locking means to lock the second catch in the release position.

In order that the present invention may be more readily understood, embodiments thereof will now be described, by way of example, with reference to the accompanying drawings.

DETAILED DESCRIPTION OF THE PREFERRED EMBODIMENT

Figure 1:
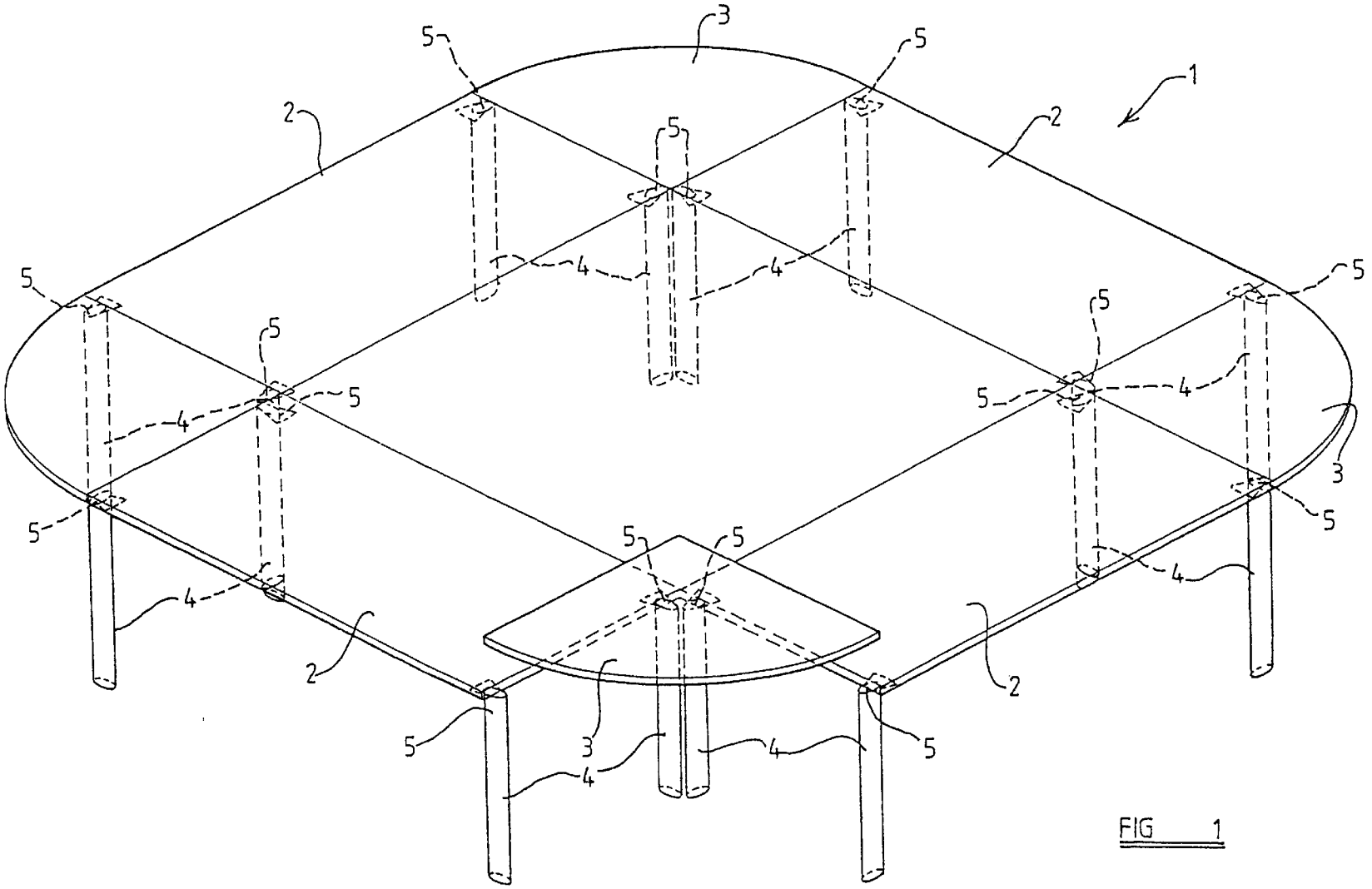
FIG. 1 is an isometric view showing a composite conference table comprising four main tabletops and four corner pieces linked together in a "raceway" configuration, one corner piece of the table being shown removed from the table.

Referring to FIG. 1, a conference/meeting table 1 or the like comprises four rectangular main tabletops 2 and four corner pieces 3 which link the respective tabletops 2 together. Rather than providing the main tabletops 2 and the corner pieces 3 with separate table legs, a single pair of table legs 4 are provided where the main tabletops and the comer piece 3 abut one another. Each of the legs 4 is joined to the table top 2 and comer piece 3 by a mounting mechanism 5 embodying the present invention. The legs 4 extend downwardly from the mounting mechanism 5. A pair of mounting mechanisms 5 thus gang together each main table top 2 to a corner piece 3.

Figure 2:
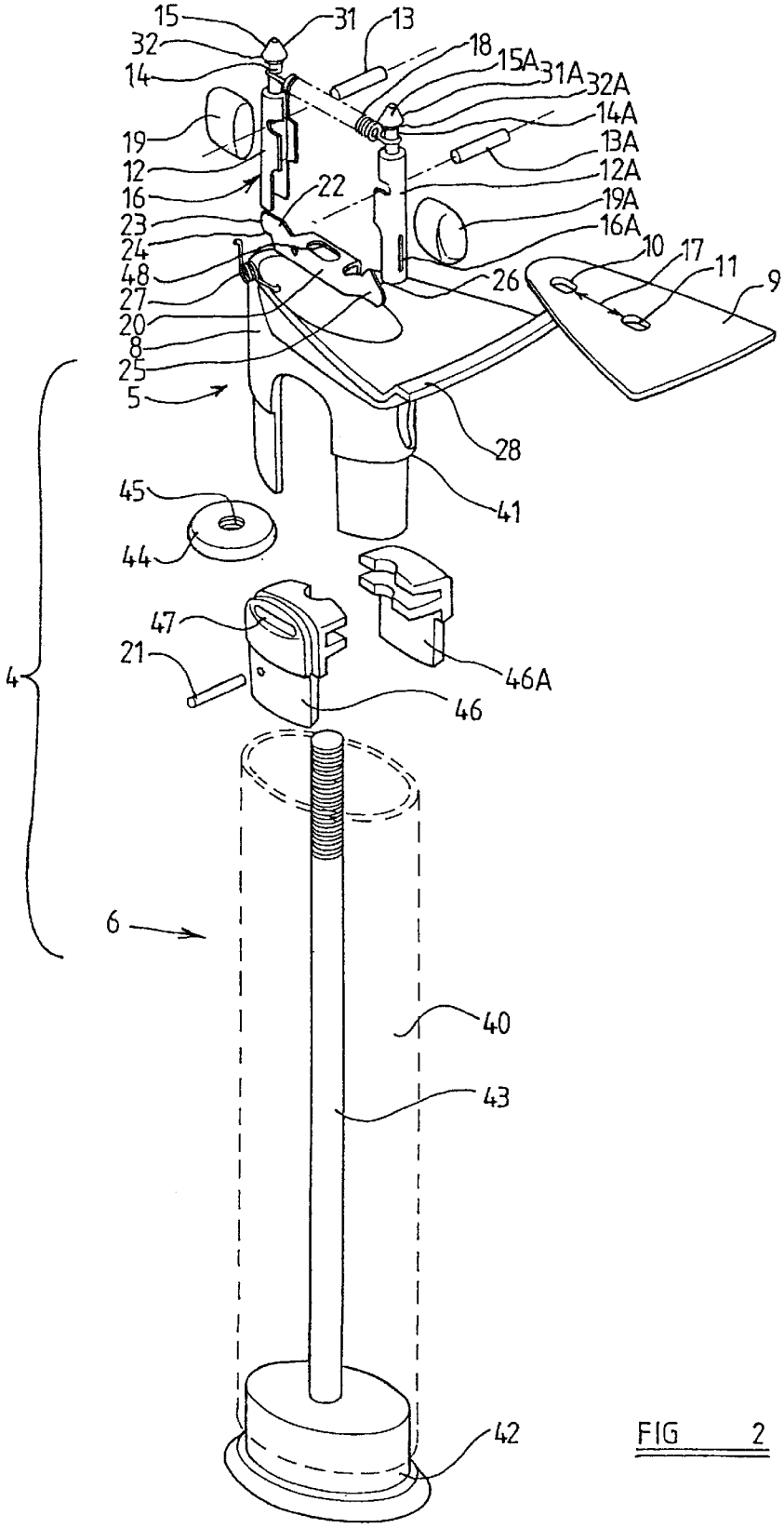
FIG. 2 is an exploded isometric view of the components of a mounting mechanism embodying the present invention together with the components comprising an adjustable height furniture leg.

A table leg 4 is shown in more detail in FIG. 2. The leg 4 comprises two separate units, the mounting mechanism 5 and a table leg element 6 which is shown in FIG. 2 as being height adjustable.

Figure 4:
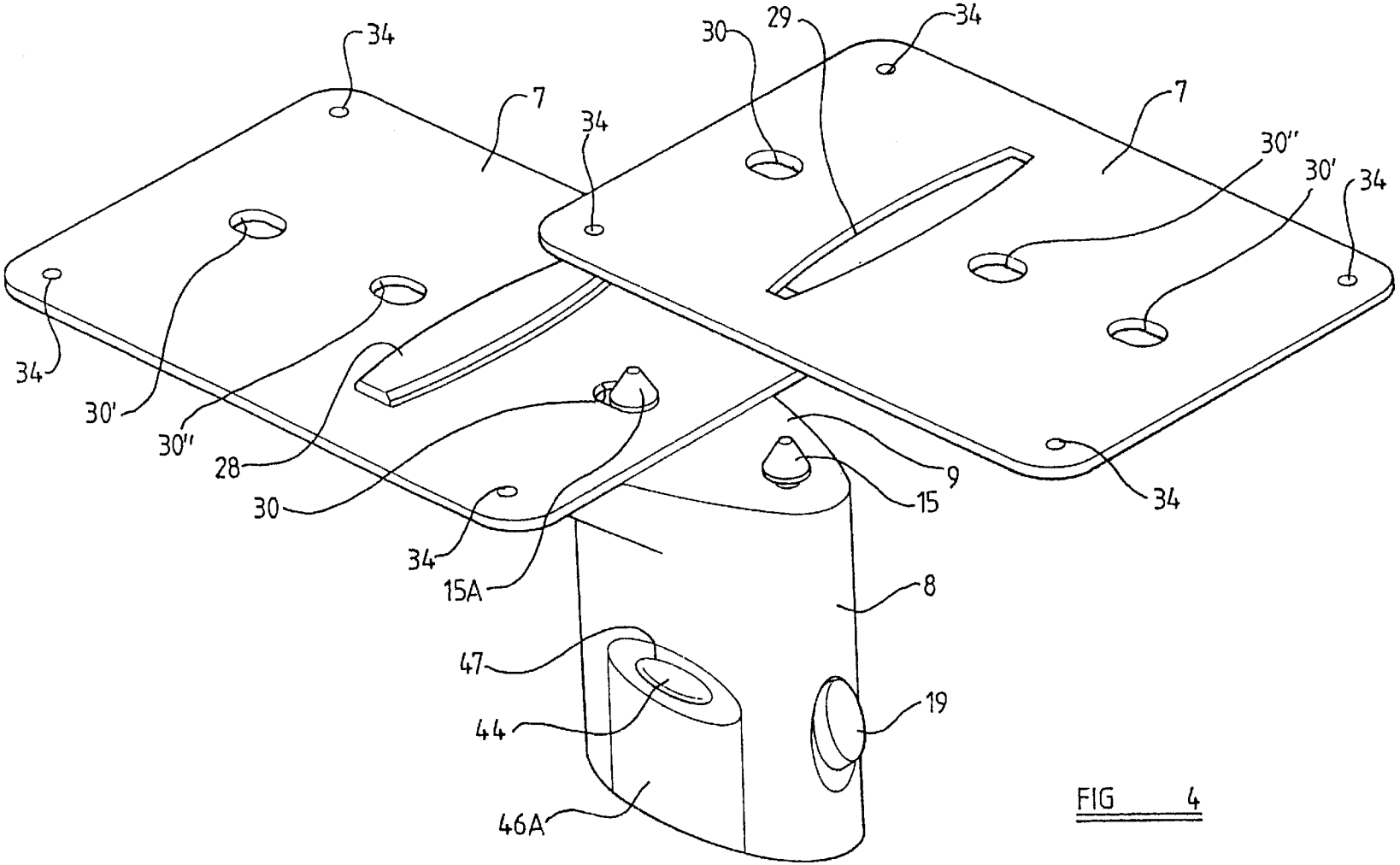
FIG. 4 is an isometric view showing the mounting mechanism of FIG. 3 in an assembled condition, the mounting mechanism being mounted to a first mounting plate and in a position to be mounted to a second mounting plate.
Figure 5:
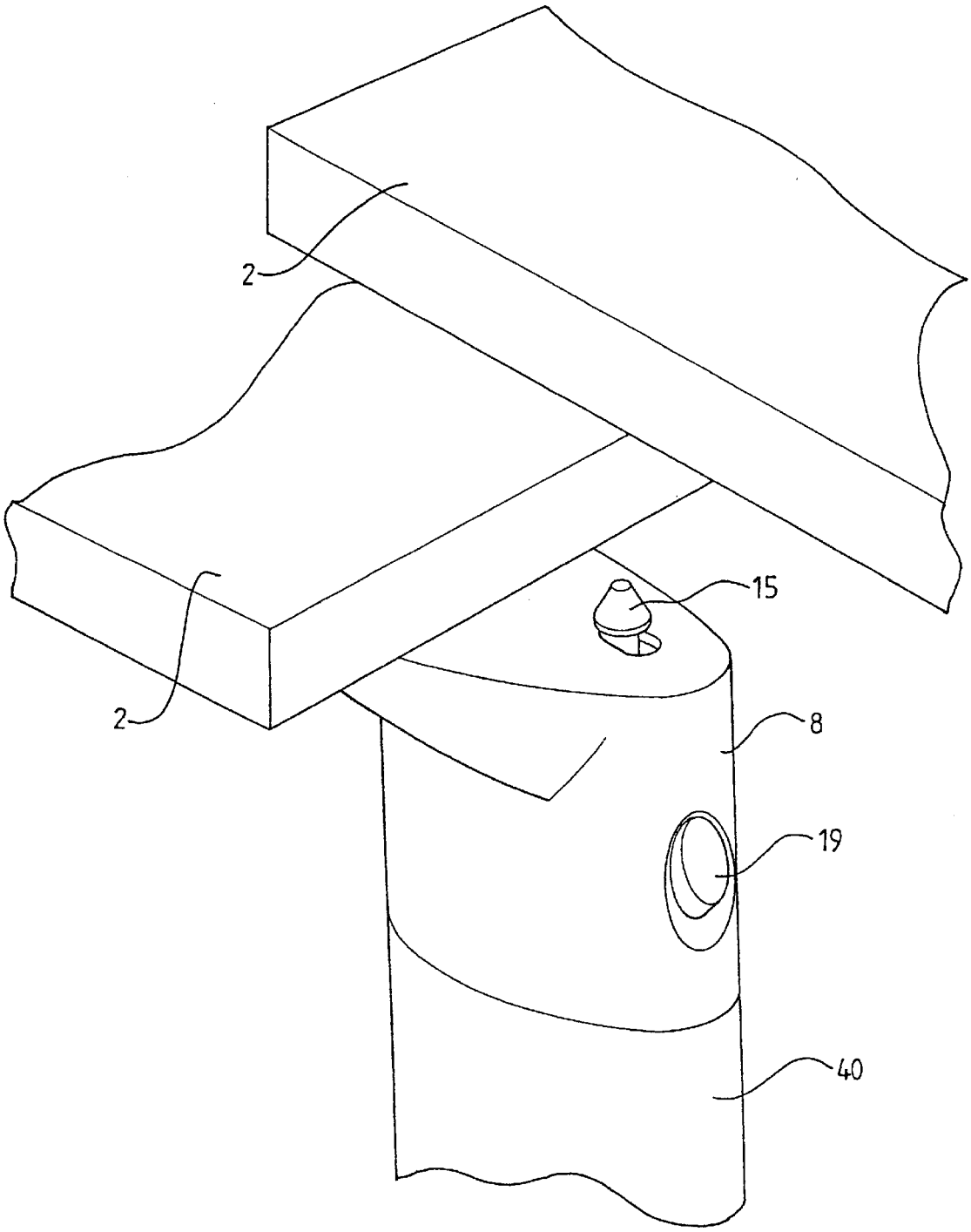
FIG. 5 shows the mounting mechanism of FIGS. 2, 3, and 4 attached to a first table top, a second table top being shown in a lifted condition.

The mounting mechanism 5 locks onto two mounting plates 7 (shown in FIG. 4). One mounting plate 7 is fixed to the underside of the table top 2 and the other identical mounting plate 7 is fixed to the underside of the corner piece 3. The mounting plates 7 will be described later in more detail.

The mounting mechanism 5 comprises a hollow housing 8 for receiving the working parts of the mounting mechanism 5. The housing 8 is an oval cylinder provided with a cover plate 9 at the furniture end of the housing 8 to close that end. The cover plate 9 is generally triangular in shape. The corners of the triangle are rounded to conform to the shape of the housing 8. The cover plate 9 is formed with two holes 10, 11, the function of which will be explained later. The opposite end of the housing 8, the open end, is formed with two cut-out portions.

The table leg element 6 comprises an elongate cylinder 40 of generally oval cross-section corresponding to the cross-section of the oval cylinder of the housing 8. The cylinder 40 is shown in phantom in FIG. 2. One end of the cylinder 40 acts as a sleeve to receive the open end of the housing 8. The outer surface of the housing 8 is provided with a step 41 to seat the housing on the elongate cylinder 40. The portion of the housing 8 below the step 41 is received in the cylinder 40 with an interference fit so that the housing is secured in the cylinder 40. A solid oval foot 42 is provided at the other end of the cylinder 40. A threaded rod 43 extends vertically up through the cylinder 40.

A wheel 44 with a threaded bore 45 is fitted on a free end 46 of the rod 43. The wheel 44 and a portion of the rod 43 are sandwiched between the two halves of a plastics insert 46, 46A. The inserts 46, 46A are wedged in the cut-out portions of the housing 8. The inserts 46, 46A are each formed with an aperture 47 to allow access to the wheel 44 so that the wheel 44 is rotatable in the inserts 46, 46A. Rotation of the wheel 44 causes the rod 43 to be raised or lowered with respect to the inserts 46, 46A and the cylinder 40 thereby raising or lowering the foot 42. Rotation of the wheel 44 thereby adjusts the height of the leg element 6.

The mounting mechanism 5 includes two separate mounting plungers 12, 12A which are pivotally attached to the inside side walls of the housing 8 by respective pins 13, 13A in a generally upright position. The upper part of each plunger 12, 12A (i.e. above the pins 13), 13A in a generally upright position is formed with a necked portion 14, 14A which terminates in a conical catch head 15, 15A. The lower half of each plunger 12, 12A (i.e. below the pin 13), 13A is provided with a vertically extending slot 16, 16A.

The conical catch heads 15, 15A of the two plungers 12, 12A extend through respective ones of the two holes 10, 11 formed in the cover plate 9. The holes 10, 11 in the cover plate 9 define between them a spacing position 17 of the plate 9 which determines a rest position of the plungers 12, 12A.

The necked portion 14 of the plunger 12 extending from the pin 13 to the conical catch head 15 retains one end of a tension spring 18. The other end of the tension spring 18 is looped around the necked portion 14A of the other plunger 12A. The two conical catch heads 15, 15A are therefore biased towards one another into the rest position but are prevented from coming into contact with one another by the spacing portion 17 of the cover plate 9.

A push button 19, 19A is attached to each plunger 12, 12A at a point below the pin 13, 13A of the respective plunger 12, 12A. The push buttons 19, 19A extend out of two apertures provided on either side of the housing 8 so that the push buttons 19, 19A are accessible from outside the housing 8.

The push buttons 19, 19A are operable to push selectively on one of the plungers 12, 12A to pivot the selected plunger from the rest position in which it abuts the spacing portion 17 to a so-called 'release' position. When moving from the rest position to the release position, the plungers 12, 12A move away from the spacer 17.

Figure 3:
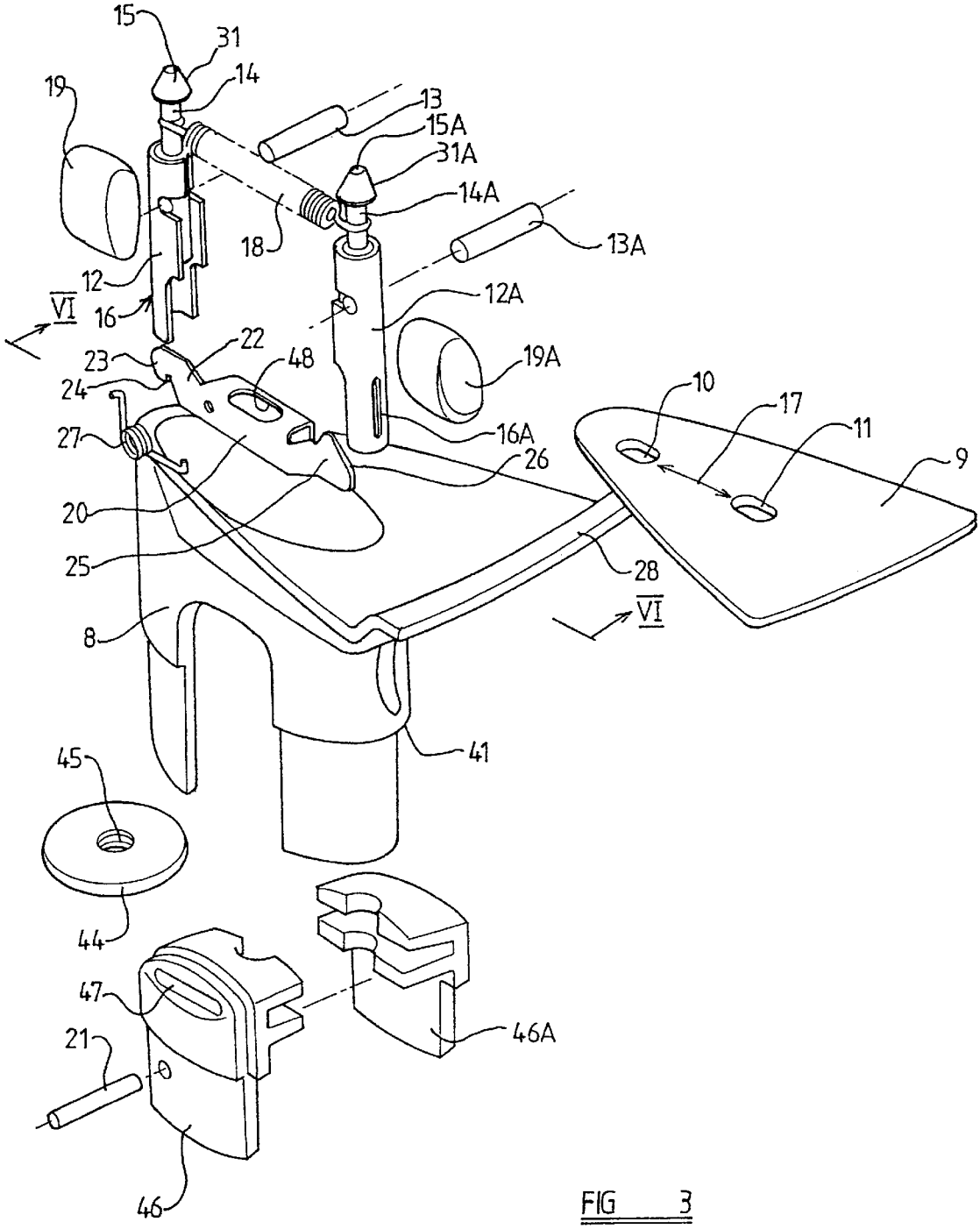
FIG. 3 is an enlarged view of the mounting mechanism shown in FIG. 2.

Referring to FIGS. 2 and 3, a rocking latch 20 is provided below the pins 13, 13A of the plungers 12, 12A and is itself pivotally mounted on the inserts 46, 46A held in the housing 8 by another pin 21. The rocking latch 20 extends substantially horizontally either side of the pin 21. One end 22 of the rocking latch 20 which is received in the vertically extending slot 16 is provided with a curved cam surface 23. The curved cam surface 23 contacts the lower edge of the vertically extending slot 16 in the plunger 12. The curved cam surface 23 of the rocking latch 20 terminates in a hook portion 24. When the plunger 12 is moved from the rest position to the release position, the hook portion 24 locks over and onto the lower edge of the slot 16 thereby locking the plunger 12 into the release position.

An aperture 48 is formed in the rocking latch 20 so that the threaded rod 43 running through the leg element 6 can pass through the latch 20. When the leg 4 is fully assembled, the rod 43 passes from the foot 42, along the main body of the cylinder 40, through the aperture 48 in the rocking latch 20 which is pivotally mounted on the inserts 46, 46A. The rod 43 passes through the semi-circular cut-outs in the inserts 46, 46A, and the threaded bore 45 in the wheel 44.

The other end 25 of the rocking latch 20 which is received within the vertically extending slot 16A in the other plunger 12A has a straight cam surface 26. The straight cam surface 26 abuts an upper edge of the slot 16A. When the plunger 12A is moved from the rest position to the release position by depressing the push button 19A, the upper edge of the slot 16A slides along the straight cam surface 26 to cause the end 25 of the rocking latch 20 to depress and the other end 22 to raise. If the hook portion 24 is locking the plunger 12 into the release position, then the lifting of the end 22 causes the hook portion to unhook from the lower edge of the slot 16 to unlock the plunger 12.

The rocking latch 20 is biased into a position such that the curved cam surface 23 contacts the lower edge of the slot 16 and the straight cam surface 26 contacts the upper edge of the slot 16A. The rocking latch 20 is so biased by a torsion spring 27 which is fitted around the pin 21 of the rocking latch 20 and has two ends, one of which hooks over the lower edge of the rocking latch 20, the other end being attached to housing 8.

The mechanism housing 8 is provided with a kinked tongue portion 28 which extends past and projects above the cover plate 9. The tongue portion 28 is engageable in an elongate slot 29 formed in the mounting plate 7 which is fixed to the underside of the table top 2. The mounting plate 7 is countersunk into a recess in the underside of the table top 2 or corner piece 3 so that the tabletops 2 or corner pieces 3 can be stacked on top of one another without there being a risk of the mounting plates 7 scratching the tip surfaces of the tabletops or corner pieces.

The tongue portion 28 is locatable in the elongate slot 29 in the mounting plate 7 such that the cover plate 9 can be rotated into a position parallel with and adjacent to the mounting plate 7. The conical catch head 15A of the plunger 12A adjacent to the tongue portion 28 thereby engages with a hole 30 provided in the mounting plate 7. A sloped surface 31A of the conical catch head 15A acts as a cam surface against the edge of the hole 30 thereby pivoting the plunger 12A about the pin 13A against the force of the tension spring 18 to allow the conical catch head 15A to be inserted in the hole 30. As soon as the widest portion, the base 32, of the conical catch head 15A passes through the hole 30, the plunger 12A is snapped back into its rest position by the tension spring 18 provided between the two plungers 12, 12A. The base 32 of the conical catch head 15A thereby sandwiches the mounting plate 7 between itself and the cover plate 9 thus engaging and retaining the mounting plate 7 to provide a secure and strong attachment between the table top 2 and the mounting mechanism 5. The rest position is also termed the engaged position to denote the securing function provided by the plungers 12, 12A.

As shown in FIG. 4, the other plunger 12 remains exposed. A second table top 2 with another identical mounting plate 7 attached thereto is lowered onto the mounting mechanism 5 causing the sloped surface 31 of the conical head catch 15 of the exposed plunger 12 to engage in the hole 30 in the mounting plate 7 to lock the exposed plunger 12 to the mounting plate 7 in a similar manner to the other plunger 12A. Thus, the exposed plunger is also able to engage and retain a mounting plate 7 to provide a secure and strong attachment between the table top 2 and the mounting mechanism 5.

In this manner two tabletops 2 are ganged together by a single mounting mechanism 5 embodying the present invention. The mounting mechanism 5 also provides means for releasing the mechanism 5 from a selected one of the two mounting plates 7 and hence, for example, from a selected table top 2.

Referring to FIG. 4, as well as being able to gang two tabletops 2 together using the two mounting plates 7, the mounting mechanism 5 is also attachable to a single table top 2. For attachment to a single table top, the tongue portion 28 is located in the slot 29 in the mounting plate 7 in the opposite sense to that shown in FIG. 4. In this manner, the plungers 12, 12A engage in two respective holes 30', 30" in mounting mechanism 5 to they attaching the mounting mechanism 5 to the single mounting plate 7.

Figure 6:
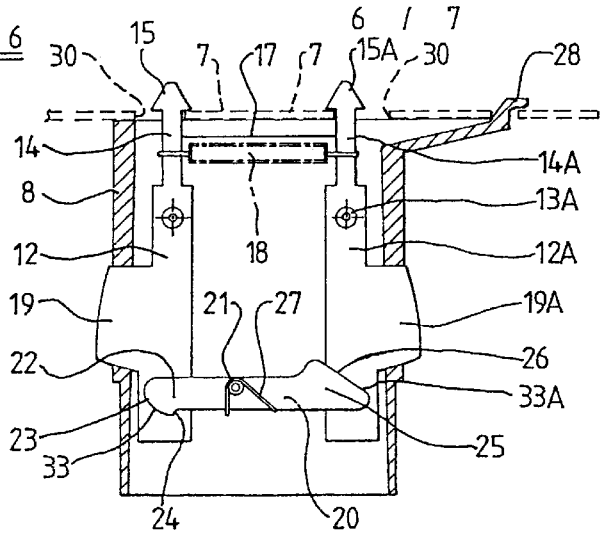
FIGS. 6, 7, and 8 are schematic cross-sections through the mounting mechanism along the line VI—VI.
Figure 7:
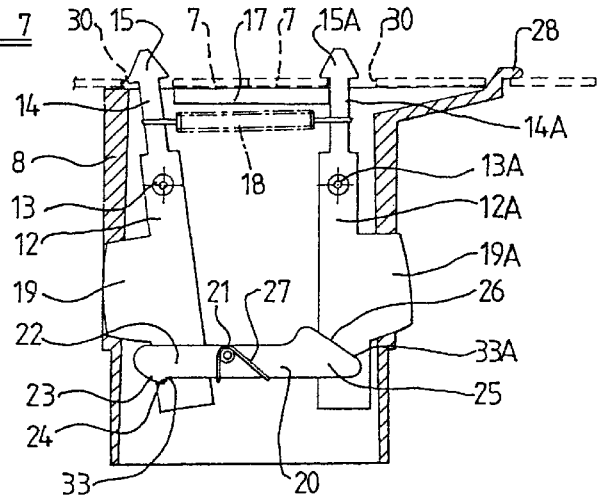
Figure 8:
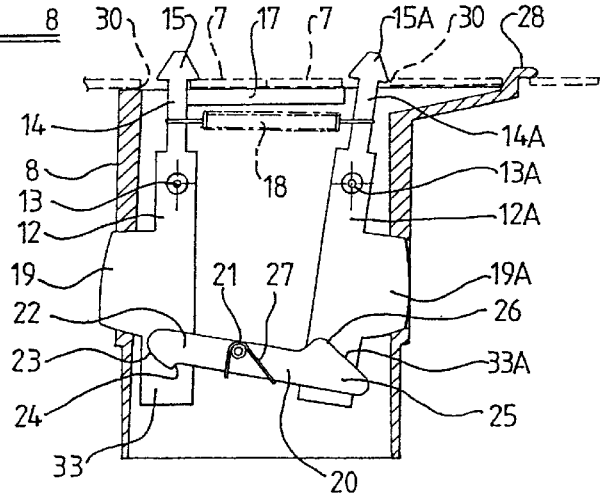

Referring to FIGS. 6, 7 and 8, these show a schematic version of the workings of the mounting mechanism 5. In these figures, the functions of the lower edge of the slot 16 and the upper edge of the slot 16A are replaced by a respective pin 33, 33A on each of the plungers 12, 12A.

FIG. 6 shows the plungers 12, 12A in the rest or engaged position. In this position the conical catch heads 15 are locked onto the two mounting plates 7 which are shown in phantom.

To release a corner piece 3 from the mounting mechanism 5, the push button 19 is depressed as shown in FIG. 7. The plunger 12 thereby moves from the rest or to the release position. As previously explained, the hook portion 24 locks the plunger 12 into the release position. Referring back to FIG. 1, it can thus be appreciated that by depressing all the push buttons 19 of the mechanisms 5 locking a particular corner piece 3, that corner piece 3 is unlocked from the other tabletops 2. Because the plungers 12 are all locked into the release position, the corner piece 3 is easily removed by a single person. It should be noted that releasing the corner piece 3 does not cause any of the tabletops 2 adjacent that corner piece to be released.

To release an adjacent table top 2, the other push button 19A associated with the other plunger 12A is depressed. This moves the other plunger 12A from its rest or engaged position to its release position as shown in FIG. 8. By depressing the push button 19A, the rocking latch 20 is pivoted to raise the end 22 to unlock the hook portion 24 from the plunger 12 which is allowed to return to its rest or engaged position.

The mounting plate 7 is fixed to a piece of furniture by way of fastening elements such as screws or the like which are received in fixing holes 34 formed around the periphery of the mounting plate 7. One consideration when fixing a mounting plate 7 to a piece of furniture is that it must be possible to insert the tongue portion 28 of the catch plate 9 through the elongate slot 29 in the mounting plate 7 without interfering with the piece of furniture upon which the mounting plate 7 is to be mounted. Further, the recess in which the mounting plate 7 is secured must provide sufficient clearance for the conical catch head 15 to prevent any interference with the working action of the conical catch head 15. Therefore, appropriate portions of the furniture are cut away or spacer washers (not shown) may be provided between the mounting plate 7 and the furniture to provide such clearance space between the furniture and the mounting plate 7. It is envisaged that the mounting plate 7 may be formed integrally with the table top 2 or corner piece 3.

Another aspect of the present invention provides a transit leg comprising a leg portion having a foot at one end for resting on a floor surface and a catch part at the other end which is operable to engage with a furniture part to retain the furniture part, the catch part locks onto the furniture part and a release position in which the catch part is releasable from the furniture part, the catch part being biased into the engaged or locking position.

A further aspect of the present invention provides a detachable leg for furniture comprising an elongate leg portion having a foot at one end for resting on a floor surface and a catch part at the other end which is operable to detachably engage with a furniture part to retain the furniture part, the leg being longitudinally extensible to adjust the height of the furniture part.

Figure 9:
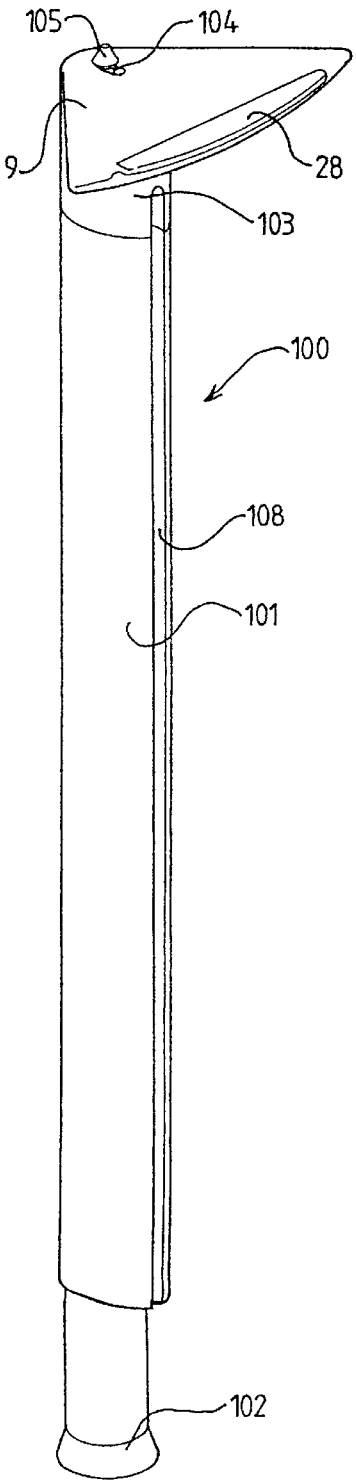
FIG. 9 is a perspective view of a transit leg embodying another aspect of the present invention.

FIG. 9 shows a transit leg 100 embodying these two aspects of the present invention. The transit leg 100 comprises an elongate hollow aluminum extrusion 101 having a generally oval cross-section as seen in FIG. 9. One end of the extrusion 101 houses a plastics molded foot 102 for resting on the floor surface. The foot 102 is height adjustable with respect to the extrusion 101. The other end of the extension 101, the furniture end, is provided with a mounting mechanism 103 similar to that previously described with reference to FIGS. 2, 3 and 4. Unlike the previously described mounting mechanism, this mounting mechanism is provided with only a single pivotally mounted plunger 104. The plunger 104 is movable between an engaged position in which a catch part 105 of the plunger engages with and is retained by the furniture part and a release position in which the catch part is releasable from the furniture part. The plunger 104 is biased into the engaged position by a tension spring 106 (shown in FIG. 10) which is fixed between the plunger 104 and an inner wall of the extrusion 101.

Figure 10:
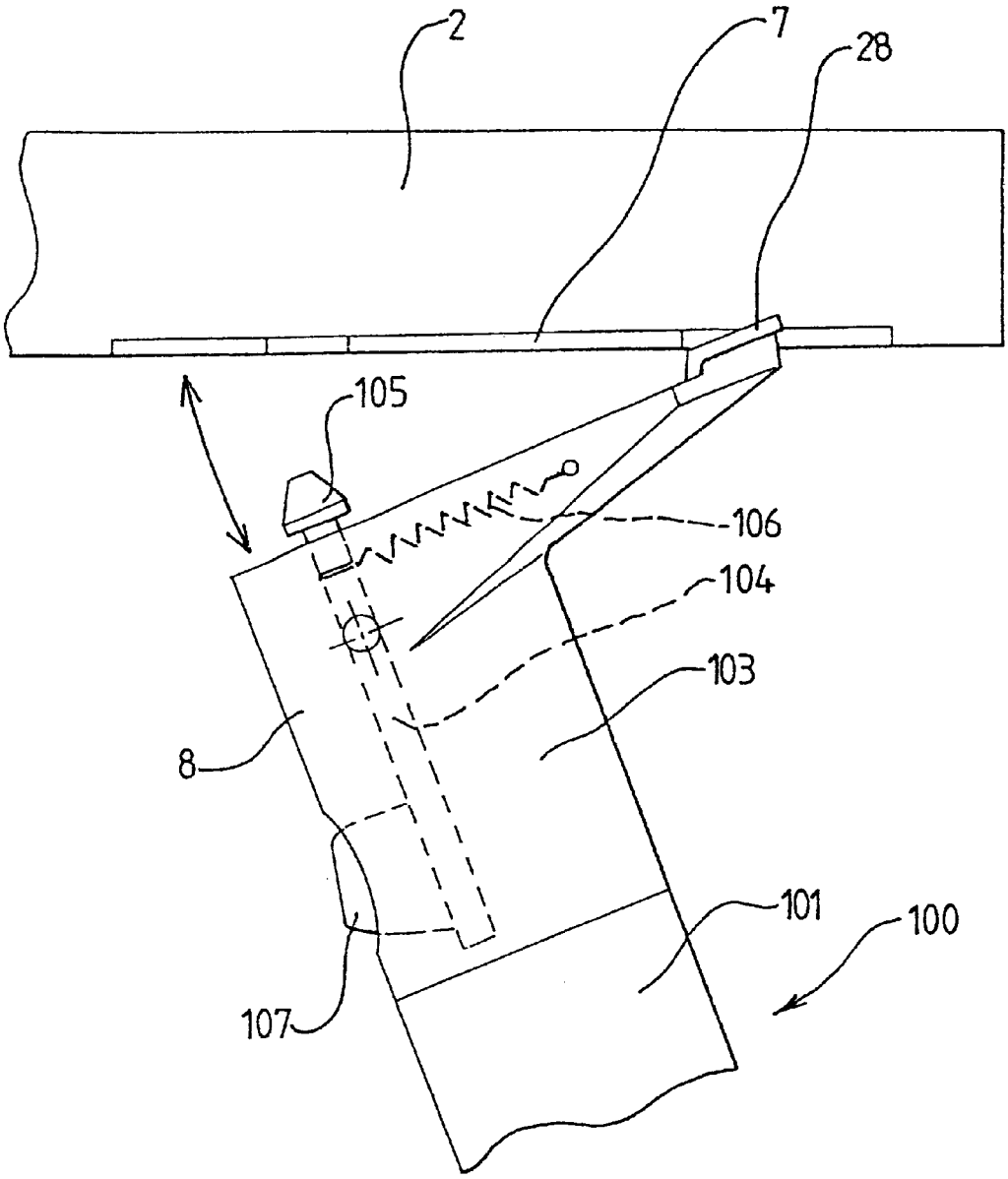
FIG. 10 is a side view of a part of the transit leg of FIG. 9, part of a plunger and part of a push button being shown in phantom.

As shown in FIG. 10, the lower part of the plunger 104 below the point at which the plunger 104 is pivotally mounted is provided with a push button 107. The push button 107 projects through an aperture in the extrusion 101. When the push button 107 is depressed, the plunger 104 is pivoted from the engaged position to the release position.

Preferably, a channel 108 is formed along the length of the extrusion 101. The channel 108 may receive telephone or power supply wiring.

A further aspect of the present invention provides a mounting mechanism comprising a first catch movable between an engaged position in which the first catch is engageable with a furniture part to retain the furniture part and release position in which the first catch is releasable from the furniture part, and a second catch movable between an engaged position in which the second catch is engageable with another furniture part or the same furniture part to retain that furniture part and a release position in which the second catch is releasable from that furniture part.

A mounting mechanism embodying this aspect of the present invention comprises the mounting mechanism shown in FIG. 3 but omitting the rocking latch 20 therefrom. Accordingly, the two plungers 12, 12A are no longer mechanically linked except by the tension spring 18 which biases both plungers 12, 12A into the engaged position.

It will become apparent to those skilled in the art that various modifications to the preferred embodiment of the invention as described herein can be made without departing from the spirit or scope of the invention as defined by the appended claims.

The embodiments of the invention in which an exclusive property or privilege is claimed are defined as follows:

1. A leg assembly for detachably interconnecting furniture parts, comprising:

an elongated body portion having an upper end and a lower end configured to abuttingly support the leg assembly on a floor surface;

a mounting mechanism disposed on the upper end of said body portion, and including:

a first catch movable relative to said upper end between an engaged position in which said first catch is adapted to engage a first furniture part for retaining the first furniture part, and a released position in which said first catch is releasable from the first furniture part;

a second catch movable relative to said upper end between an engaged position in which said second catch is adapted to engage with a selected one of the first furniture part and a second furniture part for retaining the same, and a released position wherein said second catch is releasable from the selected one of the first and second furniture parts;

said first and second catches adapted to simultaneously engage the first furniture part in a first configuration, said leg assembly solely mounted to the first furniture part when in the first configuration; and said first catch adapted to engage the first furniture part in a second configuration, said second catch adapted to simultaneously engage the second furniture part when in the second configuration, said leg assembly adapted to rigidly interconnect said leg assembly to the first furniture part and to the second furniture part in the second configuration such that said leg assembly rigidly interconnects and supports the first furniture part and the second furniture part in a side-by-side ganged configuration.

2. The leg assembly as set forth in claim 1, including:

a lock for holding said second catch in said released position.

3. The leg assembly as set forth in claim 2, wherein said first and second catches are biased into said engaged position.

4. The leg assembly as set forth in claim 3, including:

a latch operably connecting said first and second catches.

5. A leg assembly for detachably interconnecting furniture parts, comprising:

an elongated body portion having an upper end and a lower end configured to abuttingly support the leg assembly on a floor surface;

a mounting mechanism disposed on the upper end of said body portion, and including:

a first catch movable between an engaged position in which said first catch is adapted to engage a first furniture part for retaining the first furniture part, and a released position in which said first catch is releasable from the first furniture part, said first catch biased into said engaged position;

a second catch movable between an engaged position in which said second catch is adapted to engage with a selected one of the first furniture part and a second furniture part for retaining the same, and a released position wherein said second catch is releasable from the selected one of the first and second furniture parts, said second catch biased into said engaged position;

a latch operably connecting said first and second catches; and a lock for holding said second catch in said released position, wherein said lock holding said second catch in said released position comprises a hook portion of said latch, said latch being engageable with said second catch for holding said second catch in said released position.

6. A leg assembly as set forth in claim 5, wherein said latch has a cam surface engageable with said first catch, whereby movement of said first catch releases said second catch from said hook portion of said latch, thereby allowing said second catch to return to said locked position.

7. The leg assembly as set forth in claim 6, including:

a housing, said first and second catches being pivotally mounted on said housing of said mounting mechanism, said latch also being pivotally mounted on said housing of said mounting mechanism.

8. The leg assembly as set forth in claim 7, including:

a resilient member for biasing said latch to engage said cam surface of said latch with said first catch.

9. The leg assembly as set forth in claim 8, wherein said first and second catches are biased towards their respective engaged positions.

10. The leg assembly as set forth in claim 9, wherein said resilient member is a tension spring.

11. The leg assembly as set forth in claim 10, wherein said mounting mechanism has a tongue portion, said mounting mechanism including:

a mounting plate having a slot for receiving said tongue portion of said mounting mechanism, a first aperture for receiving a part of said first catch and a second aperture for receiving a part of said second catch.

12. The leg assembly as set forth in claim 11, including:

a first mounting plate for attachment to the first furniture part, said first mounting plate having a slot for receiving said tongue portion of said mounting mechanism and a first aperture for receiving a portion of said first catch; and a second mounting plate for attachment to the second furniture part, said second mounting plate having an aperture for receiving a portion of said second catch.

13. The leg assembly as set forth in claim 12, wherein said tongue portion is shaped for pivotably engaging said slot, whereby said first and second catches pivot about said slot for engaging said catches with said apertures in said plates.

14. The leg assembly as set forth in claim 13, wherein said mounting plate is formed integrally with said furniture part.

15. A detachable leg assembly for furnitures, comprising:

a leg portion having a foot at one end for resting on a floor surface and a mounting mechanism at the other end which is adapted to detachably yet rigidly connect to a furniture part, said mounting mechanism including a tongue shaped portion adapted for rotational reception in an associated furniture article, said furniture mounting mechanism further including a catch movable between an engaged position in which said catch is adapted to engage an associated furniture part and a release position in which said catch is adapted to be releasable from the furniture part, such that upon installation of said leg assembly to an associated furniture part, said tongue shaped portion is inserted in the associated furniture article, and said leg assembly is rotated about said tongue shaped portion into an installed position on the furniture article, said catch adapted to move into said engaged position upon rotation of said leg assembly into the installed position, and wherein said tongue shaped portion and said catch cooperate to detachably, yet rigidly connect said leg to an associated furniture part in said installed position.

16. The detachable leg assembly for furniture as set forth in claim 15, wherein said catch part is biased into the locking position.

17. The detachable leg assembly for furniture as set forth in claim 16, including:

a housing, said catch being pivotally mounted on said housing.

18. The detachable leg assembly for furniture as set forth in claim 17, including:

a resilient member for biasing said catch part into the locking position.

19. The detachable leg assembly for furniture as set forth in claim 18, wherein said resilient member is a tension spring.

20. The detachable leg assembly for furniture as set forth in claim 19, said detachable leg assembly including:

a mounting plate having a slot for receiving a tongue portion of said detachable leg, and having an aperture for receiving a part of said catch.

21. The detachable leg assembly for furniture as set forth in claim 20, wherein said tongue portion is shaped to engage said slot, thereby allowing said detachable leg to pivot about said slot for engaging said catch part with said aperture.

22. The detachable leg assembly for furniture as set forth in claim 21, wherein said mounting plate is adapted to be formed integrally with an associated furniture part.

23. The detachable leg assembly for furniture as set forth in claim 22, including:

a push button operably connected to said catch for moving said catch into said release position.

24. The detachable leg assembly for furniture as set forth in claim 23, wherein said leg portion includes a channel for receiving wires or cables, said channel being substantially parallel to said leg portion.

25. A detachable leg assembly for furniture, comprising:

a longitudinally extensible leg portion having a foot at a lower end for resting on a floor surface and an adjustment mechanism adapted to vary the length of said leg portion in substantially infinitesimally small increments, said adjustment mechanism having an adjustment member movably mounted to said leg portion adjacent the upper end thereof, said adjustment member connected to said foot and varying the length of said leg upon movement of said adjustment member, such that said adjustment member can be easily grasped and moved, thereby changing the length of said leg while said foot is resting on a floor surface; and a mounting mechanism positioned at the upper end of said leg portion, and including a movable catch adapted to rigidly yet detachably connect said leg assembly to an associated furniture part.

26. The detachable leg assembly for furniture as set forth in claim 25, wherein said catch is movable between an engaged position in which said catch is engageable with the associated furniture part, and a released position in which said catch is releasable from the associated furniture part.

27. The detachable leg assembly for furniture as set forth in claim 26, including:

an elongated rod disposed within said leg assembly and extending between said foot and said adjustment member and interconnecting the same; wherein:

said adjustment member comprises a wheel rotatably mounted to said leg.

28. The detachable leg assembly for furniture as set forth in claim 27, wherein said catch is biased into an engaged position.

29. The detachable leg assembly for furniture as set forth in claim 28, wherein said mounting mechanism includes:

a mounting plate for attachment to a furniture part, said mounting plate having a slot for receiving said tongue portion of said mounting mechanism and an aperture for receiving a portion of said catch.

30. The detachable leg assembly for furniture as set forth in claim 29, wherein said tongue portion is shaped for pivotably engaging said slot, whereby said detachable leg pivots about said slot for engaging said catch with said aperture.

31. The detachably leg assembly for furniture as set forth in claim 30, wherein said mounting plate is adapted to be formed integrally with said furniture part.

32. The detachable leg assembly for furniture as set forth in claim 31, including:

a push button operably connected to said catch for moving said catch into said release position.

33. The detachable leg assembly for furniture as set forth in claim 32, wherein said leg portion includes a channel for receiving communication or data lines, said channel being substantially parallel to said leg portion.

34. A detachable leg assembly for furniture, comprising:

a longitudinally extensible leg portion having a foot at one end for resting on a floor surface and an adjustment mechanism for varying the length of said leg portion, said adjustment mechanism having an adjustment member movably mounted to said leg portion adjacent the upper end thereof, said adjustment member connected to said foot and varying the length of said leg upon movement of said adjustment member, such that said adjustment member can be easily grasped and moved, thereby changing the length of said leg while said foot is resting on a floor surface;

a mounting mechanism positioned at the other end of said leg portion, and including a movable catch adapted to detachably engage an associated furniture part, said catch being movable between an engaged position in which said catch is adapted to be engageable with the associated furniture part, and a released position in which said catch is adapted to be releasable from the associated furniture part, said catch being biased into an engaged position, said mounting mechanism further including a mounting plate adapted for attachment to a furniture part, said mounting plate having a slot for receiving said tongue portion of said mounting mechanism and an aperture for receiving a portion of said catch;

a housing adapted to engage said leg portion; and said catch part being pivotably mounted to said housing.

35. A mounting mechanism for detachably interconnecting furniture parts, comprising:

a first catch movable between an engaged position in which said first catch is adapted to engage a first furniture part for retaining the first furniture part, and a released position in which the first catch is releasable from the first furniture part, wherein the first catch is biased into the engaged position;

a second catch movable between an engaged position in which said second catch is adapted to engage with a selected one of the first furniture part and a second furniture part for retaining the same, and a released position wherein said second catch is releasable from the selected one of the first and second furniture parts, wherein the second catch is biased into the engaged position;

a lock for holding said second catch in said released position; and a latch operably connecting said first and second catches, wherein said lock holding said second catch in said released position comprises a hook portion of said latch, said latch being engageable with said second catch for holding said second catch in said released position.

36. An article of furniture, comprising:

a first furniture part having a side edge and a lower surface with a first catch-receiving portion;

a second furniture part having a side edge and a lower surface with a second catch-receiving portion thereon;

a leg assembly including an elongated body portion and a mounting mechanism detachably connected solely to said first furniture part when said leg assembly is disposed in a first installed position, and detachably interconnecting the furniture parts when said leg assembly is disposed in a second installed position, said mounting mechanism including:

a first catch movable relative to said body portion between an engaged position in which said first catch engages the first furniture part, and a released position in which said first catch is releasable from said first furniture part;

a second catch movable relative to said body portion between an engaged position in which said second catch engages a selected one of said first furniture part and said second furniture part for retaining the same, and a released position wherein said second catch is releasable from the selected one of said first and second furniture parts;

said first and second catches engaging said first catch-receiving portion of said first furniture part when said leg assembly is in said first installed position, said leg assembly solely mounted to said first furniture part wholly inboard of said side edge underneath said first furniture part when disposed in said first installed position; and said first catch engaging said first catch-receiving portion of said first furniture part when said leg assembly is disposed in said second installed position, said second catch engaging said second catch-receiving portion of said second furniture part when said leg assembly is disposed in said second installed position, said leg assembly positioned below said side edge of said first furniture part, and below said side edge of said second furniture part when disposed in said second installed position, said leg assembly rigidly interconnected to said first furniture part and said second furniture part such that said leg assembly interconnects and supports said first furniture part and said second furniture part in a side-by-side ganged configuration when disposed in said second installed position.

* * * * *

UNITED STATES PATENT AND TRADEMARK OFFICE

CERTIFICATE OF CORRECTION

PATENT NO. : 5,934,630
DATED : August 10, 1999
INVENTOR(S) : Williams, et al.

It is certified that error appears in the above-identified patent and that said Letters Patent is hereby corrected as shown below:

Col. 2, line 39;
"comer" should be --corner--.

Col. 5, line 20;
"mounting mechanism 5 to they" should be --mounting plate 7 thereby--.

Col. 6, line 23;
"plastics" should be --plastic--.

Col. 8, line 9;
"A" should be --The--.

Col. 8, line 49;
"furnitures" should be --furniture--.

Col. 10, line 15;
"detachably" should be --detachable--.

Signed and Sealed this

Eighteenth Day of April, 2000

*Attest:*

Q. TODD DICKINSON

*Attesting Officer*

*Director of Patents and Trademarks*